US005348075A

United States Patent [19]

Perry et al.

[11] Patent Number: 5,348,075

[45] Date of Patent: Sep. 20, 1994

[54] THE MANUFACTURE OF THIN METAL SLAB

[75] Inventors: Robert M. Perry, Hensingham; Timothy Reynolds, Tallentire; Thomas Hope, Tickhill; Kenneth T. Lawson, Hathersage, all of England

[73] Assignee: Davy (Distington) Limited, United Kingdom

[21] Appl. No.: 33,051

[22] PCT Filed: Jun. 16, 1989

[86] PCT No.: PCT/GB89/00676

§ 371 Date: Jan. 29, 1991

§ 102(e) Date: Jan. 29, 1991

[87] PCT Pub. No.: WO89/12517

PCT Pub. Date: Dec. 28, 1989

Related U.S. Application Data

[63] Continuation of Ser. No. 623,755, Jan. 29, 1991, abandoned.

[30] Foreign Application Priority Data

Jun. 16, 1988 [GB] United Kingdom ..... 8814331
Nov. 25, 1988 [GB] United Kingdom ..... 8827570

[51] Int. Cl.[5] ..... B22D 11/12

[52] U.S. Cl. ..... 164/476; 164/417; 164/418

[58] Field of Search ..... 164/476, 417, 418; 29/527.7; 623/755

[56] References Cited

U.S. PATENT DOCUMENTS

| | | | |
|---|---|---|---|
| 3,358,358 | 12/1967 | Jenks et al. | 164/476 |
| 4,493,363 | 1/1985 | Fredriksson et al. | 164/476 |
| 4,924,585 | 5/1990 | Imai et al. | 164/476 X |
| 4,926,930 | 5/1990 | Gay et al. | 164/476 |

FOREIGN PATENT DOCUMENTS

| | | | |
|---|---|---|---|
| 55-68102 | 5/1980 | Japan . | |
| 62-252647 | 11/1987 | Japan | 164/476 |
| 01209 | 2/1988 | PCT Int'l Appl. | 164/476 |

*Primary Examiner*—J. Reed Batten, Jr.
*Attorney, Agent, or Firm*—Lee, Mann, Smith, McWilliams, Sweeney & Ohlson

[57] ABSTRACT

In the manufacture of thin metal slab, a workpiece is cast in a continuous casting mould but, while still connected to the part within the mould, the workpiece is treated differently across its width to produce slab of a different width from the east workpiece and of uniform cross-section. The treatment may be rolling or forging.

3 Claims, 4 Drawing Sheets

THE MANUFACTURE OF THIN METAL SLAB

This application is a continuation of application Ser. No. 07/623,755, filed Jan. 29, 1991, and now abandoned.

This invention relates to the manufacture of thin metal slab, particularly steel slab, by a continuous casting route.

It is known from U.S. Pat. No. 4,493,363 for a workpiece of generally rectangular cross section to be cast in a continuous casting mould. During the cooling of the workpiece, solidification takes place from the outside inwards and there may be shrinkage at the centre of the workpiece where the core is of semi-solid material. The specification discloses a process where the workpiece is subjected to rolling over the portion of its length between the outlet end of the mould and where solidification of the workpiece is complete.

It is also known from JP-A-55-68102 for a workpiece of generally rectangular cross-section to be cast in a continuous casting mould and for the workpiece to be subjected to a rolling process downstream of the mould. The rolling process comprises rolling a groove in each of the opposite faces of the workpiece and then rolling the workpiece between cylindrical rolls to produce a slab of uniform thickness across its width and a width which is greater than the width of the slab prior to the rolling process.

According to a first aspect of the present invention a method of manufacturing thin metal slab comprises a continuous operation in which a metal workpiece, having a longitudinally extending central region which is of a different thickness from its longitudinally extending edge regions, is cast in a continuous casting mould and, downstream of the mould, a portion of the workpiece which is still connected to the portion thereof in the mould is subjected to a rolling process between parallel cylindrical rolls to produce a metal slab having uniform thickness across its width; characterised in that the portion of the workpiece which is subjected to the rolling process is solid and the rolling process produces a slab having a width which is different from the width of the slab as cast.

The slab so produced has a width which may be greater than or less than the width of the workpiece as it leaves the mould.

According to a second aspect of the invention, apparatus for manufacturing thin metal slab comprises a continuous casting mould having a mould passage such as to produce a metal workpiece having a longitudinally extending central region which is of different thickness from its longitudinally extending edge regions, means for cooling the workpiece and means, downstream of the mould, for rolling the workpiece to produce a slab having uniform thickness across its width, characterised in that the rolling means are located downstream of the position where the workpiece solidifies completely and the rolling means produce a slab having a width which is different from the width of the slab as cast.

In order that the invention may be more readily understood, it will now be described, by way of example only, with reference to the accompanying drawings, in which.

Figure 1:
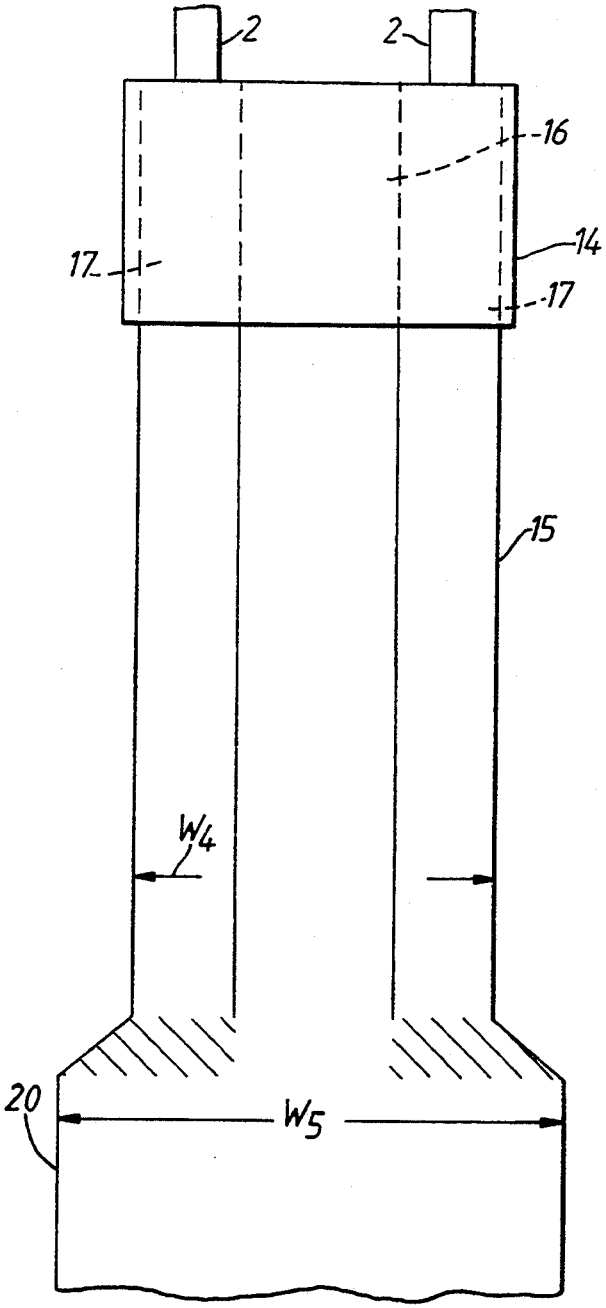
FIG. 1 is a diagrammatic front elevation of apparatus in accordance with one embodiment of the invention.
Figure 2:
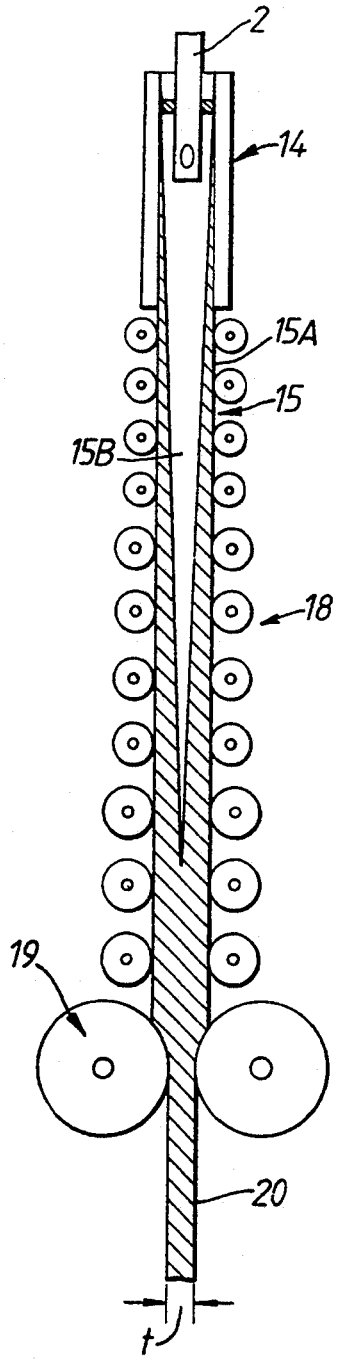
FIG. 2 is a diagrammatic side elevation of apparatus in accordance with one embodiment of the present invention.

Referring to FIGS. 1 and 2, a continuous casting mould 14 is arranged with its mould passage vertical. A pair of refractory feed tubes 2 have their lower ends projecting into the upper end of the mould passage. A containment zone 18 for guiding the workpiece 15 is arranged below the outlet of the mould passage. The mould passage has a longitudinally extending central portion 16 with an enlarged end portion 17 at each end of the central portion. The workpiece 15 as it leaves the mould has a width $W_4$ and it comprises a solid shell 15A surrounding a mushy core 15B. The shell thickens to form a solid workpiece towards the lower end of the containment zone 18.

Downstream of the lower end of the containment zone there is at least one pair of rolls 19. The rolls 19 roll the workpiece 15 by a greater extent over the end regions 17 as compared with the central region 16 to produce a thin slab 20 of uniform thickness t and width W5 where W5>W4.

Figure 3:
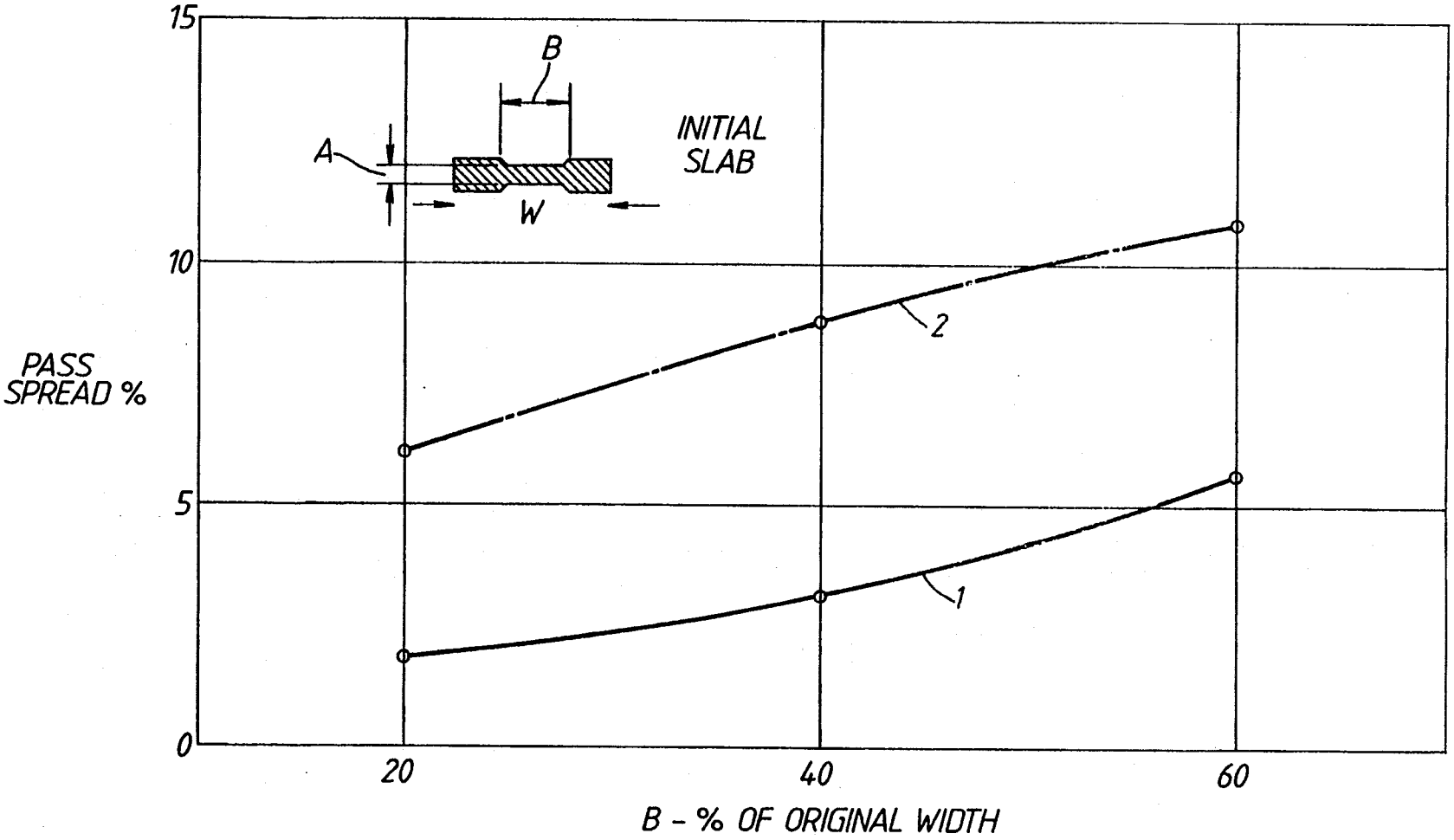
FIG. 3 is a graph showing percentage spread in a thin slab.

FIG. 3 is a graph showing the percentage spread achieved in a thin slab of particular dimensions as the width of the central region in the opposite faces is changed. The initial width of the slab as cast is W, the width of the central region is B and the thickness of the slab at the central region is A. Graph 1 is for a workpiece having a particular value of A and graph 2 is for a workpiece where the value of A is increased. It can be seen from graph 1 that, where B is 20% of W, a spread of about 2% can be achieved but, if the width of B of the central region is tripled to, say, 60% of W, then the spread is increased to 6%. From graph 2 it can be seen that, when B is 20% of W, a spread of 6% can be achieved but this is increased to about 11% when B is 60% of W.

Any or all of the rolls used to reduce the thickness of the cast slab may be cooled internally and/or externally. The hardness at elevated temperatures of these rolls may vary across the diameter of the barrel with the surface layer having the greatest hot hardness and good compressive strength, to withstand the thermal stresses, thermal fatigue due to rolling at elevated temperature and lower than normal rolling speeds.

Figure 4:
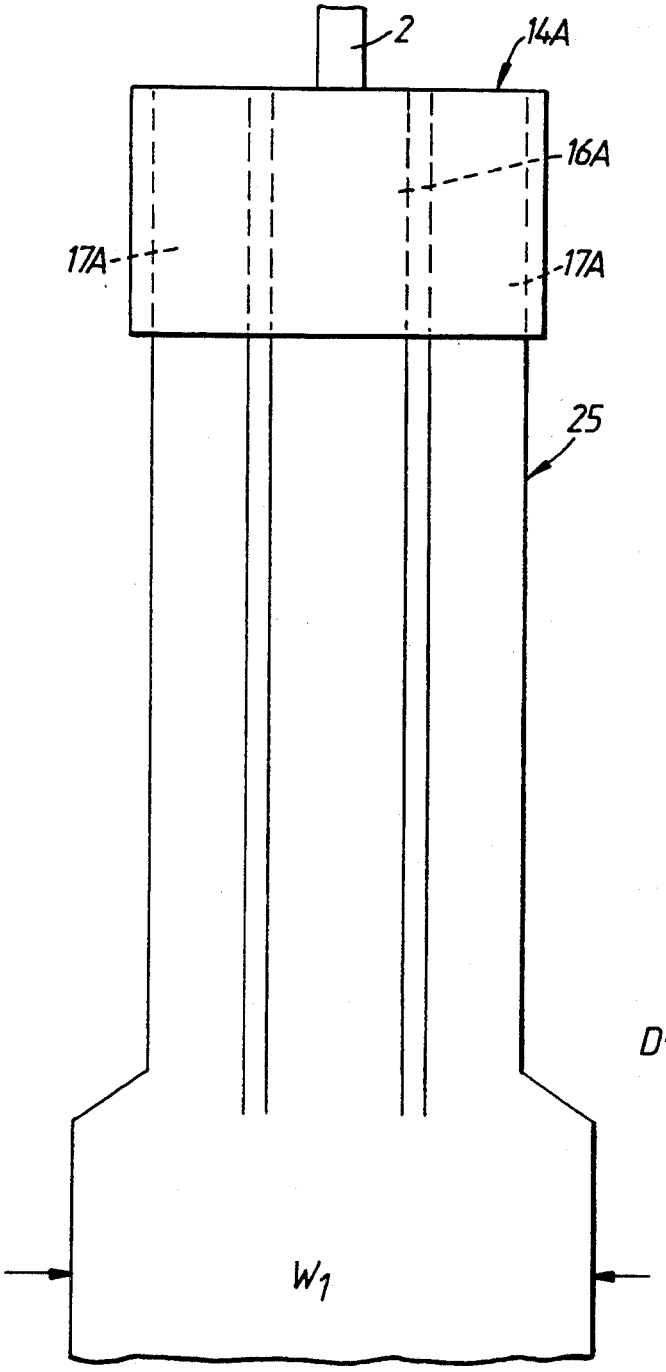
FIG. 4 is a diagrammatic front elevation of apparatus in accordance with a second embodiment of the invention.
Figure 5:
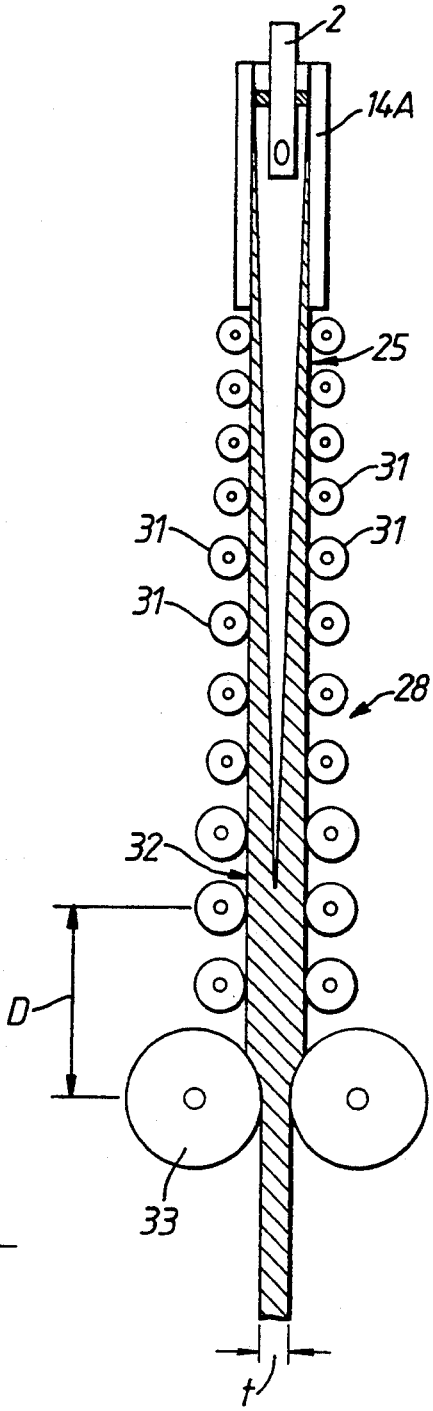
FIG. 5 is a diagrammatic side elevation of apparatus in accordance with a second embodiment of the invention.

FIGS. 4 and 5 show another casting and rolling technique in which a continuous casting mould 14A is arranged with its mould passage vertical. The mould passage has a longitudinally extending central portion 16A with an end portion 17A at each end of the central portion. The thickness of the central portion 16A is greater than the thickness of each end portion 17A. The cast slab 25 produced in the mould thus has a central portion thicker than its edge portions. The slab 25 as it leaves the mould comprises a solid shell surrounding a liquid plus mushy core. The shape of the mould cavity is relatively parallel in the direction of casting such that no working of the shell occurs. The containment zone 28 comprises a series of roll sets 31 each comprising multiple rolls arranged end-to-end and which match the mould exit shape or each support the flat faces of the slab width and incorporating support bearings across the slab width. The final thickness t of the slab is achieved by rolling the solidified centrally thick slab a safe distance D after final solidification point 32 with a width flattening pass with rolls 33 to give a rectangular flat slab of width W1 and thickness t.

Figure 6:
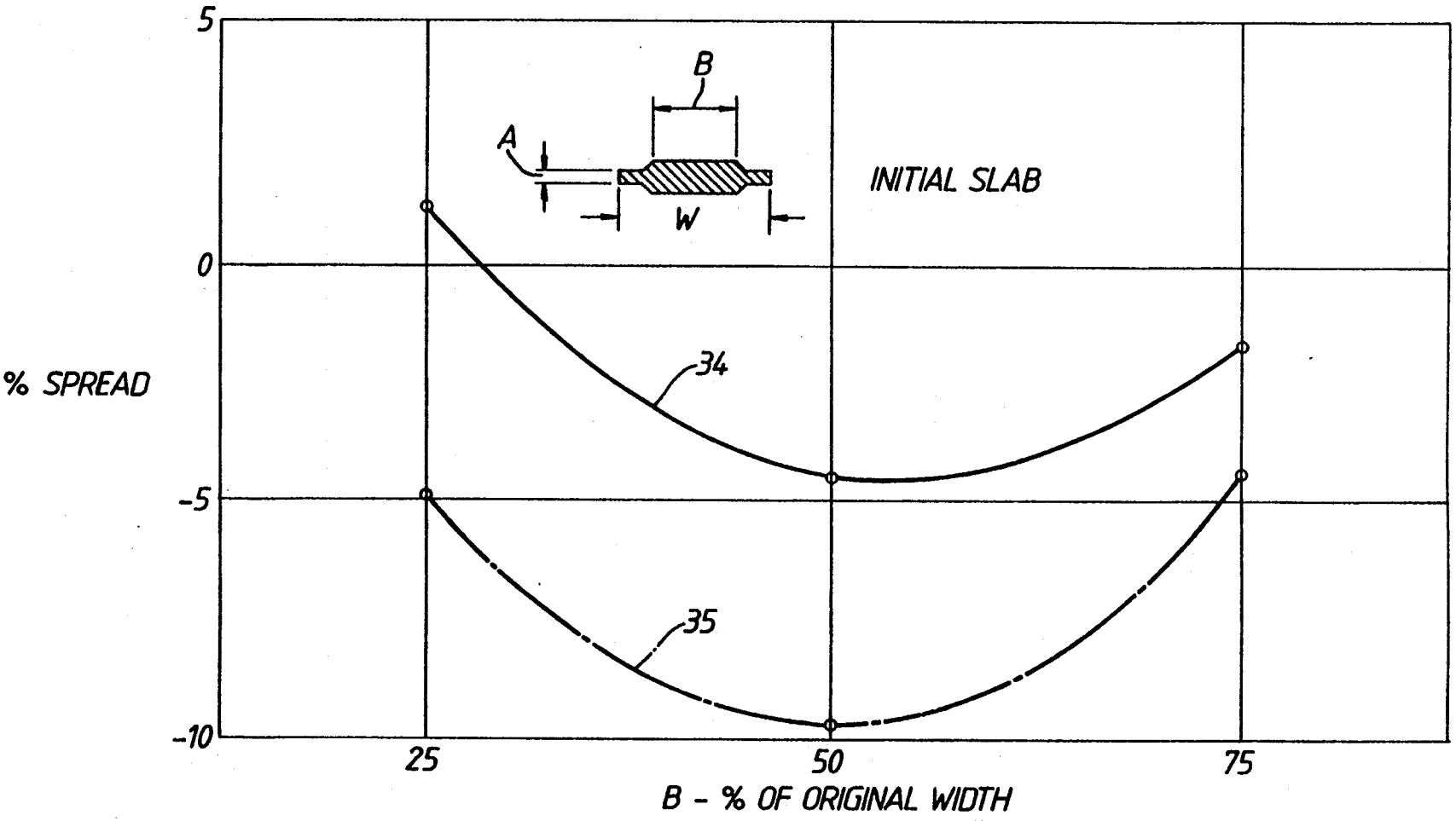
FIG. 6 is a graph showing the effect of rolling on a thin metal slab.

In FIG. 4 the width W1 is shown to be greater than the width of the cast workpiece, but the process can be used to bring about a reduction in the width of the workpiece. FIG. 6 is a graph showing the effect of rolling on a thin slab of width W where the end portions are cast with a thickness A and the width of the central region is B. Graph 34 is for a workpiece having a particular value of A and graph 35 is for a workpiece where the value of A is reduced. It can be seen from graph 34 that, if B is 25% of W, a small widening of, say, 1% of the slab occurs after rolling but, if the value of B is increased to 75% of W, then a reduction of about 2% is achieved. Furthermore, it can be seen from graph 35 that a reduction of 5% is achieved when B is 25% of W and a reduction of almost 10% when B is 50% of W. However, when B is increased to 75% of W, the reduction in width is reduced to about 4%.

The dimensions of the mould passage may be changed during the casting operation so as to vary the width of the casting as it leaves the mould. For example, the end walls of the mould which define the mould passage may be movable towards and away from each other in order to adjust the width of the workpiece cast in the mould. This adjustment of the width of the workpiece may simply compensate for the reduction in the width of the workpiece due to shrinkage between the time of casting and the commencement of differential treatment across the width of the workpiece. On the other hand, adjustment of the width of the workpiece cast in the mould may be used in combination with width adjustment downstream of the mould in order to produce thin slabs of uniform width within a considerable range of widthwise dimensions.

We claim:

1. A method of manufacturing a thin metal slab comprising the steps of providing a continuous casting mould having a mould passage therethrough extending from an inlet end to an outlet end, said mould passage having a longitudinally extending central region which is between, and is of a different thickness from, longitudinally extending edge regions; pouring molten metal into the inlet end of the mould passage and, from the outlet end of the mould passage, drawing a cast slab comprising a solid shell surrounding a non-solid core, said slab having a pair of opposite faces of a width which has a longitudinally extending central region which is of a different thickness from its longitudinally extending edge regions; and downstream of the mould at a position where the core of the slab is solid, subjecting the pair of opposite faces of a solid portion of the slab while it is still connected to the portion thereof in the mould to a rolling process between parallel cylindrical rolls to produce a metal slab of uniform thickness and having a width which is different from the width of the cast slab which is drawn from the outlet end of the mould passage.

2. A method as claimed in claim 1, in which the slab has its longitudinally extending edge regions thicker than the longitudinally extending central region.

3. A method as claimed in claim 1, in which the slab has its longitudinally extending edge regions thinner than the longitudinally extending central region.

* * * * *